United States Patent [19]

Total

[11] 4,354,887

[45] Oct. 19, 1982

[54] LABEL TRANSFER VACUUM DRUM FOR LABELLER

[75] Inventor: Robert V. Total, St. Marys, Pa.

[73] Assignee: Canadian Stackpole Limited, Scarborough, Canada

[21] Appl. No.: 327,881

[22] Filed: Dec. 8, 1981

[51] Int. Cl.[3] ..... B05B 1/00

[52] U.S. Cl. ..... 156/64; 156/357

[58] Field of Search ..... 156/64, 357, 566–568, 156/571

[56] References Cited

U.S. PATENT DOCUMENTS

| | | | |
|---|---|---|---|
| 2,936,921 | 5/1960 | Schuly | 156/357 X |
| 3,306,803 | 2/1967 | Holstein | 156/357 |
| 4,242,167 | 12/1980 | Hoffmann | 156/357 |

*Primary Examiner*—David A. Simmons

[57] ABSTRACT

An apparatus for labelling conveyed articles applies glue to the rear surfaces of labels and applies the glued labels to the articles. The apparatus comprises a device for passing the rear face of the label by a glue applicator and then applying the glued label to an article. In the absence of a label on the device, the pad for carrying labels is withdrawn as it passes the glue applicator. The label transferred to a pad is held on its face by the use of vacuum. When a label maintains vacuum on the pad face, a brake in response to the maintained vacuum is actuated to prevent withdrawal of the pad, as it passes the glue applicator. In the absence of a label, the brake is inoperative to allow the pad to withdraw and avoid application of glue to the pad face.

32 Claims, 9 Drawing Figures

LABEL TRANSFER VACUUM DRUM FOR LABELLER

FIELD OF THE INVENTION

This invention relates to labelling apparatus for gluing labels and applying them to conveyed articles. More particularly, it relates to avoiding application of glue to apparatus components used in applying a label to a conveyed article when a label is absent.

BACKGROUND OF THE INVENTION

Several types of labelling apparatus are available which apply glue to labels and subsequently apply them to conveyed containers. An example of such labelling apparatus is disclosed in Caulford et al, U.S. Pat. No. 3,450,586 and Carter, U.S. Pat. No. 3,864,187. The principal problem to be avoided in applying glue to labels is to prevent application of glue to the bare face of the pad for holding a label, should a label not be present. This can result in considerable down time on the machine, since the line has to be stopped, the glue removed from the label carrier device and then the system restarted. To avoid this problem, many attempts have been made to withdraw or avoid application of glue to the label carrier in the absence of a label. U.S. Pat. No. 3,450,586 discloses a device which senses whether or not a label is present for transfer onto a vacuum pad which holds and carries the label for glue application. If a label is not present on the transfer device, the vacuum pad is withdrawn by use of a cam latching mechanism to avoid contact with the glue applying device.

Similarly with U.S. Pat. No. 3,864,187, in the absence of a label on a vacuum pad which supports the label for application of glue, the pad is withdrawn. The vacuum pad is normally biased to its extended position so as to always contact the glue applicator. In the absence of a label on the pad, there is loss of vacuum which causes a cam follower to drop downwardly from the pad and engage a cam to withdraw the pad to avoid contact with the glue applicator. This approach necessitates the use of camming devices which often require adjustment because of wear.

Use may be made of photoelectric sensors to determine the presence of a label on a vacuum pad for holding a label to be glued. An example of this system can be found on an automatic labeller sold by Stackpole Machinery Company of Scarborough, Canada under the trademark SM 1700. With that device, a photoelectric cell determines if the label has or has not been transferred to a vacuum pad. Upon sensing the absence of a label, an air cylinder is actuated to move a cam into position which retracts the pad by way of a cam follower attached to the pad, so as to avoid contact with the glue applying station. The pad is, however, in its normal position urged outwardly to its extended position which contacts the label with the glue applying device.

Other approaches, which have been used in either withdrawing the carrier for a label to which glue is to be applied, or retracting the glue applicator, are disclosed in U.S. Pat. Nos. 3,112,236; 3,322,597; 3,982,472 and 4,242,167. In Canadian patent 502,685, a system is disclosed for retracting the glue roller for applying glue to a label on detecting the absence of a label on the vacuum pad. The absence of the label is sensed by a loss of vacuum on the vacuum pad and, in turn, actuates the device for retracting the glue roller out of the path of the vacuum pad. Retraction of the glue roller is rather cumbersome because of its size and the amount of glue the applicator usually carries.

The above systems function satisfactorily in a reasonably clean environment; however, with mechanisms which involve mechanical arrangements to retract the pad or retract the glue applicator to avoid application of glue to a bare pad, the devices may wear and require adjustment. A further consideration is that the devices normally work in a dusty environment caused primarily by minute paper particles working their way into the various pneumatic systems. For example, with the system of U.S. Pat. No. 3,864,187, minute paper particles may collect in the cylinder arrangement to obstruct the free fall of the cam in the absence of vacuum in the chamber. As a result, the pad remains in its outermost position and glue is applied to the bare pad. Systems which rely upon photoelectric sensing are not always reliable, because of the short time within which the electric eye must sense the presence or absence of a label. The sensors are subject to electronic failure and variation in sensitivity which can also result in application of glue to a bare pad. Another consideration is that with many of the systems the presence of a label is sensed before transfer to the pad. There is not an absolute sensing of whether or not a label is present on the pad. This may happen in the improper transfer of label to pad where the label covers only a portion of the pad. The pad can remain in its extended position and have glue applied to the exposed portion of the pad.

The method and apparatus, according to this invention, overcomes a number of the above problems by normally retracting the pad as it passes by the glue applicator and in response to vacuum being maintained on the pad due to the presence of a label, the pad is retained in its extended position so as to apply glue to the label for subsequent application to a conveyed container.

SUMMARY OF THE INVENTION

The apparatus, according to this invention, for labelling conveyed articles has a pad to which vacuum is supplied to hold a label for purposes of application of glue to the label and for subsequent contacting with a conveyed article. The apparatus retracts the vacuum pad on the absence of a label before passing the glue applicator. The apparatus includes means which, in response to a vacuum being maintained on the pad due to the presence of a label, is actuated to prevent retraction of the pad so that glue is applied to the label for subsequent application to a conveyed container.

According to an aspect of the invention, the apparatus includes means for transferring a label from a supply of labels onto a face of the pad which is mounted on a revolving drum. Means controls a supply of vacuum to an outlet means on the pad face. The control means provides a vacuum to hold a transferred label on the face and removes the vacuum as the label is applied to a conveyed container to release a label from the pad face. The revolving drum passes such held label by means for applying glue to the label back and contacts such glued label back to a conveyed article in a manner to deposit the glued released label on the article.

The pad is movable relative to the drum, as it rotates, from an extended position which contacts a label back with the glue applying means to a retracted position which avoids contact with the glue applying means.

Means is provided for biasing the pad towards the retracted position. Means is also provided for extending the pad from its biased retracted position to an extended position, the extending means positioning the pad in the extended position for receipt of a label and also allows, in the absence of a label, the biasing means to retract the pad to its retracted position before the pad passes the glue applying means.

Means is provided which, in response to a vacuum being maintained by a label on the pad face, retains the pad in the extended position to apply glue to a label back and apply the glued label to a conveyed article. The retaining means is inactive in response to the loss of vacuum on the pad face due to the absence of a label over the outlet means, thereby permitting the biasing means to retract the pad to its retracted position and avoid contact with the glue applying means.

The method, according to this invention, comprises transferring a label onto a pad and holding such label on the pad by using vacuum. The pad is then passed by means for applying glue to the label and contacting the pad to an article to place the glued label on the article and removing the vacuum to release the label at the time of contacting the label to the article. The pad is normally withdrawn as it is passed by the glue applying means. The vacuum, as maintained by the presence of a label on the pad, is used to actuate a brake means, which precludes withdrawing the pad to apply thereby glue to the label on the pad.

BRIEF DESCRIPTION OF THE DRAWINGS

Preferred embodiments of the invention are shown in the drawings wherein:

FIG. 4, is an enlarged view of the vacuum actuated retaining means of FIG. 5.

DETAILED DESCRIPTION OF THE PREFERRED EMBODIMENTS

Figure 1:
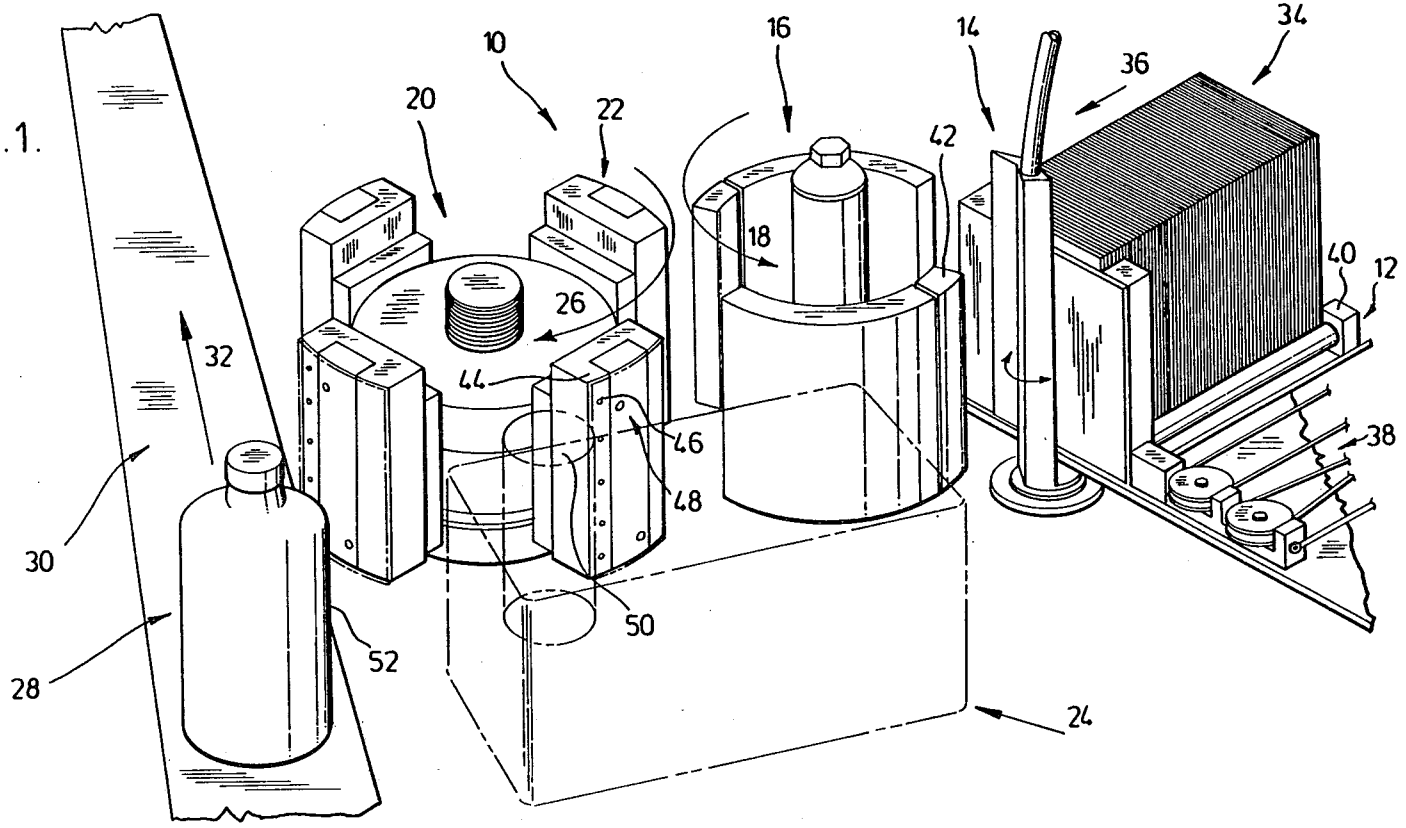
FIG. 1 is a perspective view of the labelling apparatus for applying individual labels from a stack of labels to spaced apart conveyed articles.

The labelling apparatus generally designated 10 comprises a a supply of labels which, according to this embodiment, is in the form of a stack of labels in the label magazine generally designated 12 with a label picking mechanism 14. A label gripper drum 16, revolving in the direction of arrow 18, grips a label edge presented by the picker 14 and carries it around for transfer onto the label vacuum pad 20. The rotation of the gripper drum 16 and the vacuum pad drum 20 are coordinated such that an edge of the label, as gripped by the gripper drum, is ready for transfer to the leading edge of a pad 22 at which time vacuum is applied to the pad to hold the label on the pad. The vacuum pad 22 carries the label past a glue applying device 24 which applies the glue to the rear face of the label. Continued rotation of the vacuum drum in the direction of arrow 26 brings the pad into tangential contact with an article surface generally designated 28 to be labelled as conveyed on conveyor 30 in the direction of arrow 32. The speed at which the vacuum drum rotates is coordinated with the speed of the conveyor 30 to contact the glued label to the article surface and, with the removal of vacuum from the vacuum pad, the released label is deposited on a container. Such technique in labelling articles is well known in the art, as exemplified in the previously referred to U.S. Pat. No. 3,450,586.

In operating the apparatus 10, the stack of labels generally designated 34 are advanced in the direction of arrow 36 by a cable arrangement generally designated 38. This cable arrangement may advance the labels in the manner described in the U.S. Pat. No. 3,450,586 by applying pressure to a rear plate, not shown, which is behind the stack of labels 34 and connected to block 40. A special form of label advance is disclosed in copending U.S. patent application Ser. No. 245,905 filed Mar. 20, 1981. The picker bar 14 withdraws a label edge from the stack and presents it to the gripper drum 16. Although not shown, the gripper drum 16 includes a gripper jaw which clamps the extracted label edge between the jaw and block portion 42. As the drum continues to rotate in the direction of arrow 18, it withdraws the remainder of the label from the stack 34. The labels are oriented in stack 34 so as to present their rear surface outwardly. In timing the rotation of the gripper drum 16 with the vacuum pad drum 20, the edge of the label held by the gripper jaw moves tangentially with the leading edge portion 44 of the vacuum pad 22. The leading portion 44 includes a plurality of outlets 46 which have vacuum applied thereto just prior to or at the same time that the label comes in contact with this edge of the vacuum pad. At this time, the gripper drum opens its jaw and the leading edge of the label is sucked onto the outlets 46 to hold the label across the face 48 of the vacuum pad.

With the vacuum pad in its extended position, the drum 20, as it rotates, defines a circular path which is tangential with the gripper drum 16, the glue applying roll 50 and the circular surfacer 52 of the article 28 to be labelled as it is conveyed along in the direction of arrow 32. Although not shown, appropriate supports for the article 28, which in this instance is a container, are provided to support it while the vacuum pad touches the glued label to the surface of the container.

With the vacuum pad thus extended, the rear surface of the label, as presented by the pad, has glue applied thereto by the roller 50. Various forms of glue applying devices may be used, such as disclosed in U.S. Pat. No. 3,358,645 to Caulford et al, issued Dec. 19, 1967. The glue applicator 24 always remains stationary, because of the mass of glue associated with the glue applicator roll device 50. As previously explained in the absence of a label, it is important to withdraw the vacuum pad 22 to avoid application of glue to the bare pad surface 48, since this would necessitate shutting down the apparatus 10 and cleaning the pad.

Figure 2:
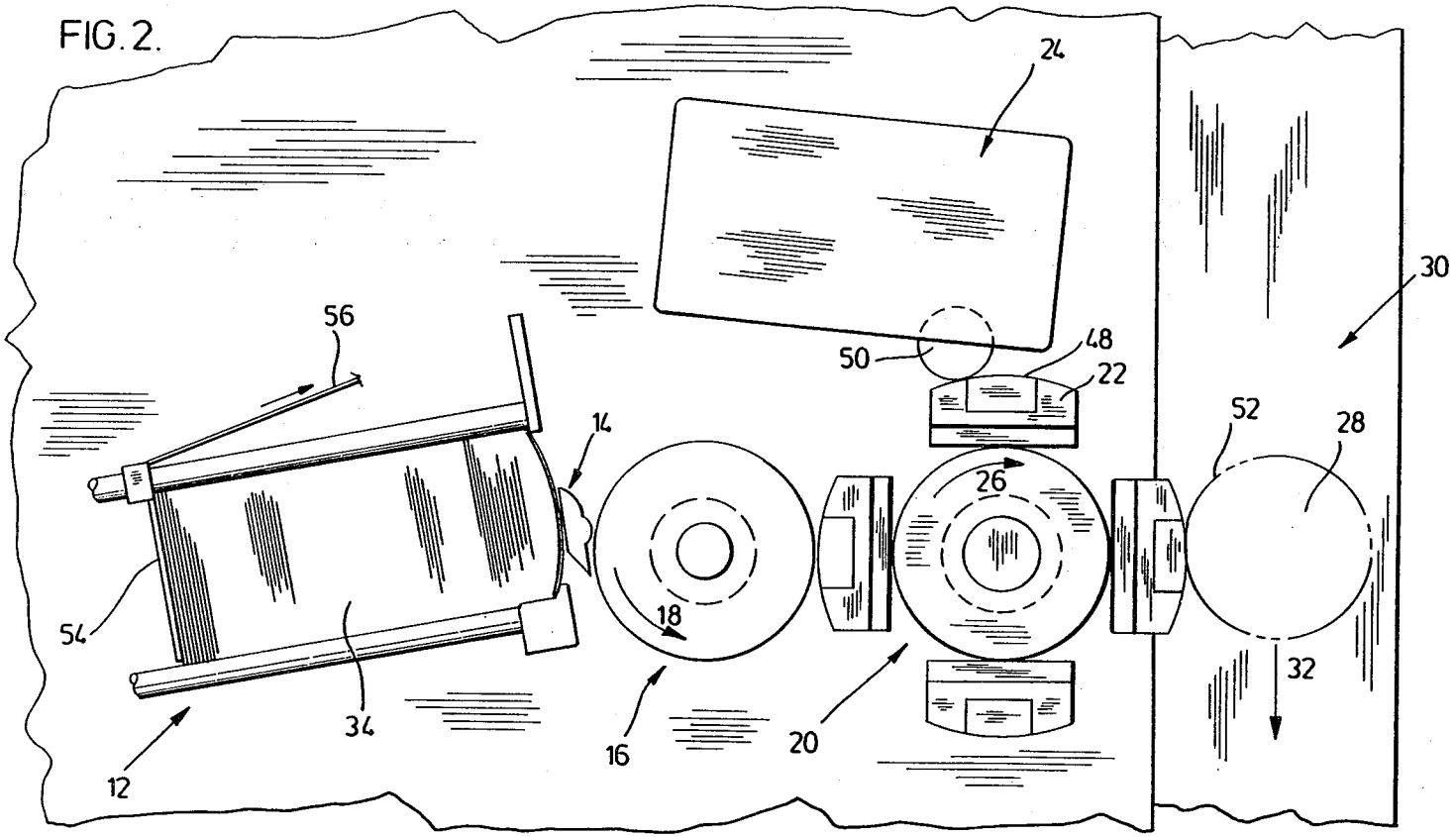
FIG. 2 is a plan view of the apparatus of FIG. 1.

In FIG. 2 the tangential path of travel defined by the pads 22 rotating on the drum 20 is shown. Each vacuum pad 22 tangentially meets the gripper drum 16 to effect transfer of the label picked from the stack of labels 34.

Glue applicator roll 50 is tangentially contacted by the pad 22 and subsequently the pad 22 with glued label contacts the surface 52 of the container 28. As is more clearly shown in FIG. 2, the plate 54 is urged towards the feed section for the label picker 14 by cable 56 as pulled forwardly by a pneumatic cylinder arrangement, which may be of the type described in U.S. Pat. No. 3,450,586.

There are situations when the gripper drum 16 has not gripped a label for transfer to the vacuum pad 20. This may be when the stack of labels runs out in the label magazine 12. Another situation is when the stack of labels jam in the magazine and the label picker 14 is unable to extract labels from the stack. A further consideration is that a label may be somewhat disoriented on the gripper drum, so that when transferred to a vacuum pad 22 it is off centre and may only cover a portion of the vacuum pad. In extremes, the label may be improperly transferred to the vacuum pad and fal off the pad shortly after transfer. In any of these situations, the vacuum pad should be withdrawn, so that the bare portions or the entire bare face of the vacuum pad is not covered with glue. This invention accomplishes this feature by mounting a vacuum pad on the drum in a manner so that, during every cycle of each vacuum pad, it is naturally withdrawn from the glue roll 50 if a label is absent. Only when a label is present on the vacuum pad is a brake applied to prevent withdrawal of the pad. This is different from the prior art systems, in that they are all normally biased to the extended position and a mechanism is required to retract the pad in the absence of a label. This requires an electrical or mechanical device to effect the retraction, because the pad is biased to the extended position.

Figure 3:
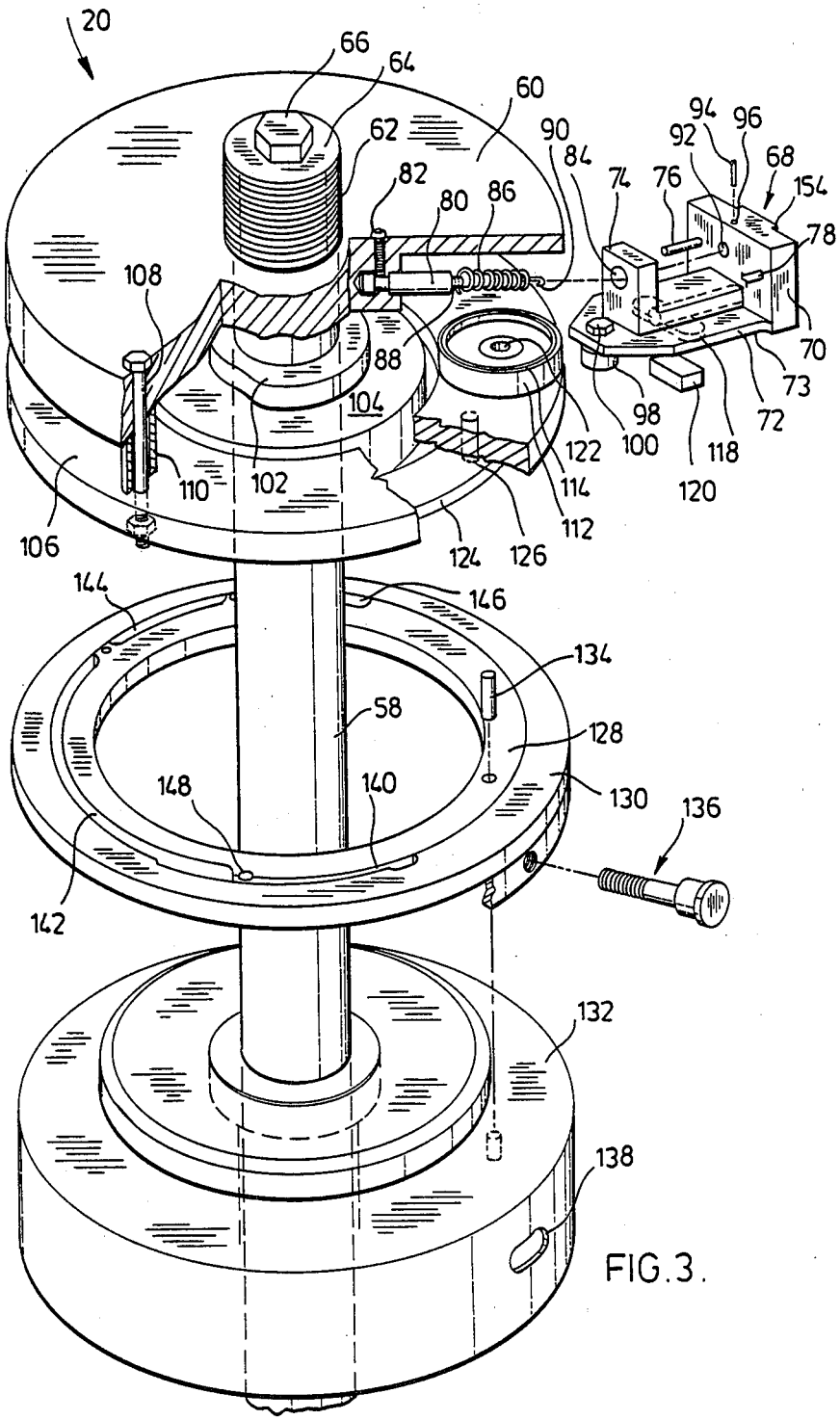
FIG. 3 is an exploded view of the drum on which the labelling pads are mounted.

Referring to FIG. 3, the device for holding the pad in its extended position, according to a preferred embodiment, is shown. The vacuum pad drum 20 is mounted on a spindle 58, which rotates at a predetermined speed so as to be coordinated with the movements of the gripper drum 16 and the conveyed container 28. The vacuum pad drum comprises a circular plate 60 which is secured to the spindle 58 and held in position by a spring, washer and bolt arrangement 62, 64 and 66. Each vacuum pad is mounted on a slide block arrangement generally designated 68. It consists of pad support 70 which has extending rearwardly therefrom base plate portion 72 with carrier block 74 mounted thereon. Pad support 70 includes two pins 76 and 78 which extend rearwardly from the block and cooperate with bores in the circular drum plate 60 to provide for a reciprocal radial movement of the pad support block 68. Extending through the upright portion of block 74 is pin 80 which is secured at one end to the circular drum plate 60 by threaded Allen screw 82. The pin 80 extends through aperture 84 of the upright portion of block 74 and has a spring 86 with its first end secured to the pin 80 at 88. The other end 90 of the spring is secured to the pad support 70, as it extends through aperture 92 and is secured therein by pin 94 which is inserted into the bore 96. The base plate portion 72 has a cam follower 98 secured thereto by a bolt 100. The spring 86 acts, according to this embodiment, as the means for continuously biasing the cam follower 98 against a cam 102 secured to hub 104 which is stationary relative to the spindle 58. The biasing means 86, when the braking device is inactive, causes the cam follower 98 to follow the outline of cam 102. The outline of cam 102 is designed so that the pad is in its extended position, so as to tangentially contact the article to be labelled and the gripper drum. The cam follower falls into a recess portion of the cam 102 to retract the pad and thereby avoid contact with the glue applicator roll 50.

Mounted to the underside of the vacuum drum plate 60 is an annular support ring 106. The support ring is secured to plate 60 by way of bolts 108 which are threaded into plate 106. The equal spacing of ring 106 from plate 60 is determined by the spacers 110. Mounted on the upper surface of plate 106 is a vacuum actuated braking device 112 having a planar annular portion 114 which is parallel with the planar underside 73 of base plate 72 of the pad mounting device 68. The disc 112 is mounted on conduit 122, so as to be movable vertically relative to the ring 106, yet incapable of radial movement relative to the drum plate 60. The disc is urged upwardly against the underside of plate 72 by a resilient spring shown in more detail in FIG. 5. The enclosure is defined by the annular ridge 114 and, when a vacuum is drawn therein, the ridge 114 is drawn tightly against plate 72 to frictionally engage the plate 72 with sufficient force that with the pad in the extended position, the spring 86 cannot withdraw the pad from the extended position. Thus the disc 112 in response to a vacuum being maintained on the face of the pad by the presence of the label, brakes the retracting movement of the pad carrier 68. The manner in which this is accomplished will be discussed in more detail with respect to the remaining Figures.

Mounted to the underside of plate 72 in a recess 118 is a valve plug 120 which serves to close off the opening of conduit 122 in the disc 112, when the vacuum pad is moved to its retracted position. This shuts off the source of vacuum to the pad. A control device is provided for determining when vacuum is applied to the vacuum pad through the opening 122 in disc 112. Secured to the underside of ring 106 is a wear plate portion 124, which is secured to ring 106 by pins 126. Located in the wear ring 124 is an aperture in communication with the conduit 122 for each pad. This opening in the ring 24, although not shown, is aligned with the ports defined in the vacuum control rings 128 and 130. Inner ring 128 is secured to base portion 132 by pin 134. The outer ring 130 may be swivelled relative to the inner ring and its position is secured by way of locking bolt 136 which is securable to base 132 through aperture 138. The relative positions of rings 128 and 130 defines the beginning of the first vacuum port 140. The adjustable feature determines when the vacuum is drawn for the various sizes of labels to be transferred from the gripper drum to the vacuum pad. Other vacuum ports 142 and 144 provide vacuum to the face of the pad to hold the label, after it is transferred to the pad for application of glue thereto, until it is abut to be applied to the container. An additional port 146 is provided which is under pressure and exerts a blast of air through the pad to effect a better release of the label onto the container as it is contacted therewith. The port portions are isolated from one another by cylindrical seals 148 so as to isolate the effect of a label not being present on the pad with subsequent loss of vacuum in that particular port area. Therefore, as the aperture in wear plate 124 revolves over the various ports 140, 142, 144 and 146, the appropriate vacuum or air pressure is applied to the pad in the preparation and application of a label to a container.

Figure 4:
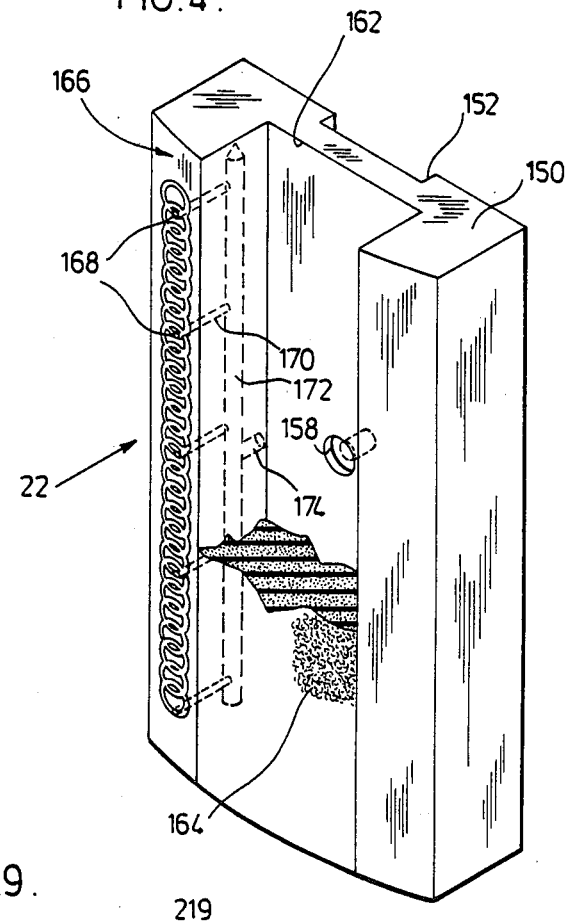
FIG. 4 is a perspective view of a labelling pad.

The vacuum pad 22, as shown in more detail in FIG. 4, consists of a metal block body portion 150 with a longitudinally extending rear channel portion 152 which mates with the longitudinally extending projection 154 on the pad carrier block 68 shown in FIG. 3. As shown in more detail in FIG. 5, the pad carrier block 68 has a stud 156 extending therefrom which extends through the aperture 158 in pad block 150. A threaded Allen Screw nut 160 is used to connect the pad block to its carrier. On the face of the vacuum pad block is another longitudinally extending channel 162. Mounted in this part of the channel is compressible foam 164 to provide some resiliency in contacting a glued label to a container. On the leading portion 166 of the vacuum pad, the vacuum outlet means, according to this embodiment, is provided in the form of a plurality of ports 168. As shown in dot, these ports 168 communicate with internal ducts 170 which are all interconnected by a common manifold 172. Centrally of the manifold 172 is another internal duct portion 174 which communicates with the duct 176 of the pad carrier block, shown in FIG. 5. With vacuum applied to the outlet ports 168 when the label transfer gripper drum brings a label edge into contact with this leading edge 166 of the vacuum pad, the vacuum at ports 168 pull the label against the vacuum pad leading edge to draw it away from the label transfer drum. With the label leading edge held in this position, it is then passed by the glue roll where the remainder of the pad face supports the label, as glued is applied thereto. The location of the outlet ports 168 is important, because they in essence determine if the label is properly positioned on the pad for gluing. If a label is misaligned on the pad, not all of the ports 168 would be covered so that the loss of vacuum indicates not only the absence of a label, but also a misalignment of label on pad. It is appreciated that, depending upon the shape of a label to be applied, various shapes of vacuum pads may be formed and are thus interchangeable with the pad carrier block by the release of Allen screw 160.

Figure 5:
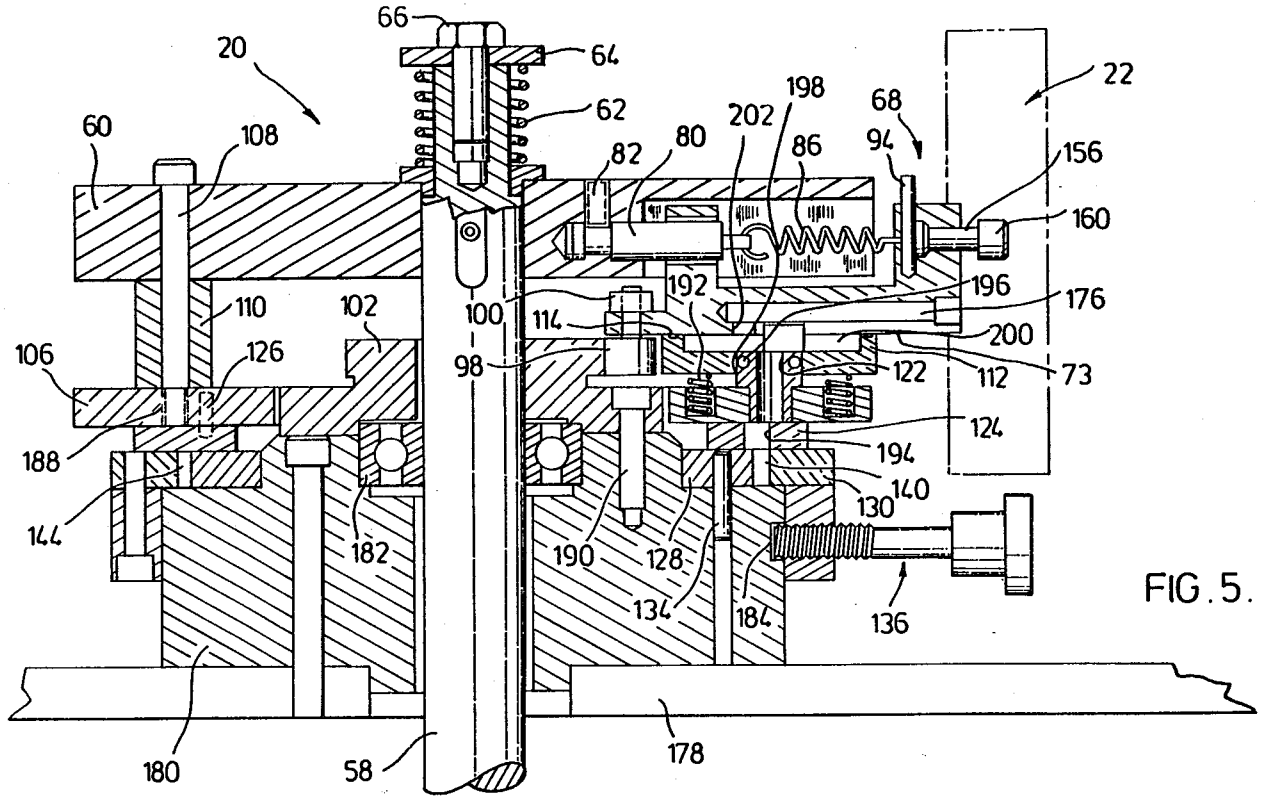
FIG. 5 is a section through the pad and associated drum where the pad is in position to receive a label.

The cross-sectional view of FIG. 5 shows in greater detail the relationship of the assembled components of FIG. 3. A base plate 178 is secured relative to the machine frame (not shown). Extending upwardly through the base plate 178 is the spindle 58. Secured to the base plate 178 is a supportive hub 180 in which the spindle 58 is bearingly mounted by bearings 182. The split rings 128 and 130 of the vacuum control are shown in their secured positions relative to the hub 180. The adjustable knob 136, as it is screwed into the hub 180 in aperture 184, fixes the outer ring 130. The inner ring 128 is pinned to the hub 180 with pins 134. For the position shown in FIG. 5 in the vaccum control rings, port 140 is presented on the righthand side and port 144 on the lefthand side. Although not shown, appropriate vacuum supply ducts supply vacuum through the hub 180 to the ports 140, 142 and 144 and pressurized air is supplied to port 146. As shown in more detail on the lefthand side of FIG. 5, ring 106 is secured to the drum plate 60 by the bolt 108 as threaded into the collar in aperture 188 with appropriate spacers 110. Cam 102, with the spindle extending therethrough, is secured to hub 180 with Allan screws 190.

The retaining device for holding the pad in its extended position, namely the disc 112, is mounted on ring 106. Located between the upper surface of ring 106 and the underside of disc 112 are springs 192 which lightly urge the disc upwardly against the planar underside of plate portion 72. The aperture 194 in the wear ring 124 is aligned with port 140. In communication with aperture 194 is the conduit 122 in the disc 112. The conduit 122 is sealingly mounted in the ring 106, so that there are no vacuum losses. An O ring 196 is provided to sealingly engage the circular opening 198 in the disc. The plate portion 70 of the pad carrier block has duct 176 extending therealong which is in communication with the enclosed space 200 defined by the disc annular ridge portion 114 bearing against the underside of plate 72. The duct 176 communicates with this enclosed space via aperture 202. As shown more readily in FIG. 8, duct 176 extends laterally of the pad holder block 68 to provide an outlet at 204. As can be gathered from FIG. 4, duct 174 is aligned with outlet 204, so as to distribute vacuum to the outlet means in the form of ports 168.

Figure 8:
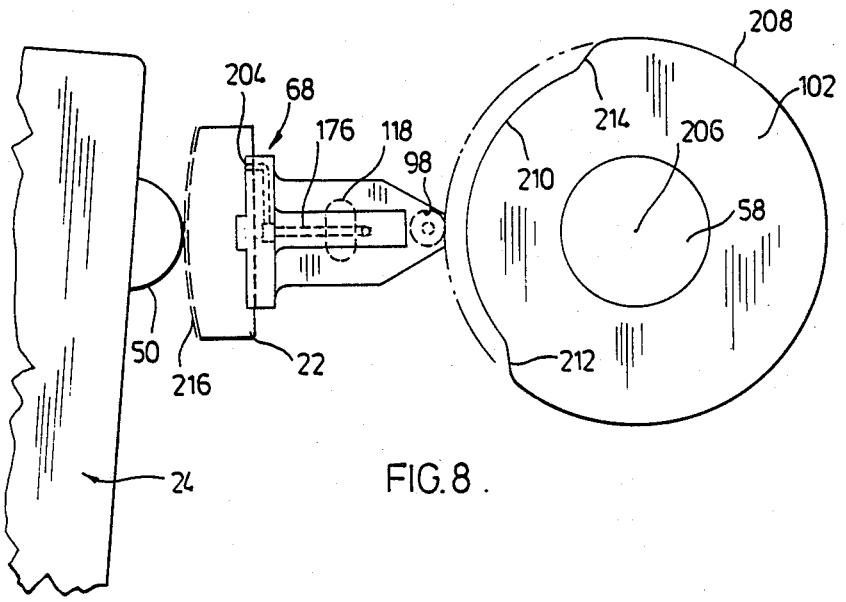
FIG. 8 is a view of the cam arrangement which provides for withdrawal of the pad in the absence of a label on the pad's face as it passes the glue applicator.

Referring to FIG. 8, the cam 102 is shown in plan view and is made up of two diameters relative to the axis 206 of the spindle 58. The first diameter is defined by cam circumferential portion 208. With the cam follower 98 engaged against circumferential portion 208 by spring 86, the pad 22 is in its extended position so as to tangentially contact the label transfer mechanism 16, the glue applicator 24 and the surface of the article to be labelled. The cam 102 has a second diameter defined by circumferential portion 210, which is less than the diameter of portion 208. Recessed portion 210 has a lead-in ramp 212 to allow the cam follower to smoothly flow into reduced portion 210. In the follower 98 moving up to the increased portion 208, an additional ramp 214 provides a smooth shifting of the pad to its extended position. With the follower 98 urged inwardly at all times by spring 86 and with no label on the pad 22, the cam 102 provides for retraction or withdrawal of the pad 22 to its retracted position. With the pad so withdrawn, the pad would not contact the glue applicator roll 50. However, with the arrangement of FIG. 8, the retaining or braking mechanism 112 has been engaged by the presence of a label 216 on the pad face. With the pad in its held extended position, the glue applicator roll 50 applies glue to the label rear face in preparation for contacting the glued label to a conveyed article.

Figure 6:
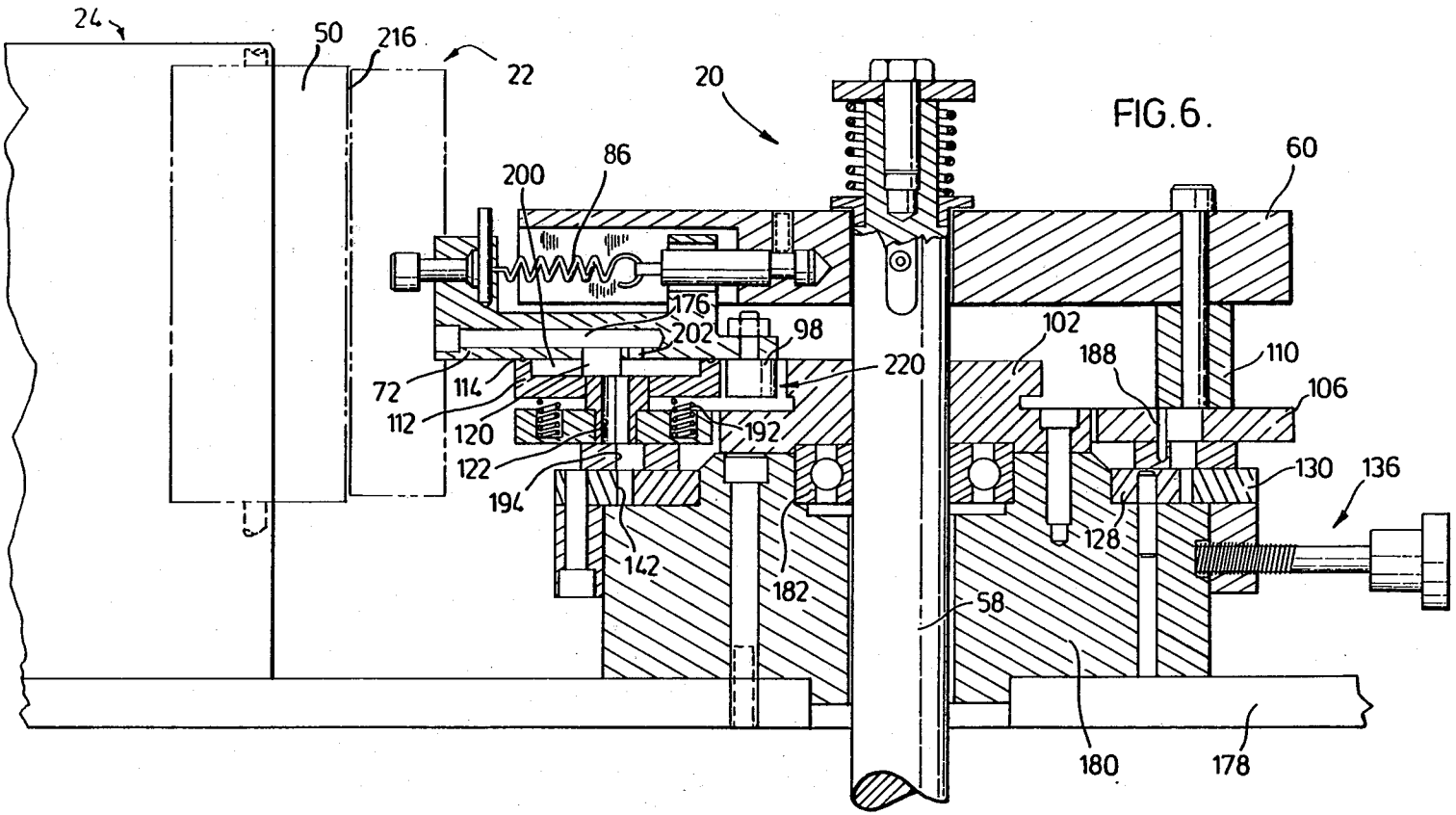
FIG. 6 is a section through the pad and drum where the pad is in position to have glue applied to a label on the pad's face.

Turning to FIG. 6, a section through the vacuum pad drum 20 is shown with the pad contacting the glue applicator roll 50. With a label 216 present on the vacuum pad 22, the face of the label overlies the vacuum outlet ports 168. As mentioned, this holds the label against the pad and at the same time establishes a vacuum, as provided through the control means in the form of rings 128 and 130 through port 142 in the enclosed space 200 defined by the disc annular ridge 114. This vacuum results in the disc 112 being drawn tightly against the underside of plates 72 of the pad carrier. With the disc 112 mounted on annular ring 106, the disc cannot move inwardly relative to the vacuum drum. By way of the engagement of the annular ridge 114 with the underside 73 of the carrier plate 72, the frictional force developed by the vacuum drawn is sufficient to prevent the spring 86 from retracting the pad 22. As a result, the cam follower 98 remains spaced from the cam 102 as indicated by the space 220. Thus the label 216, with the pad held in its extended position, has glue applied thereto by glue applicator roll 50.

The pad retaining mechanism, therefore, in response to vacuum being maintained in the system by the presence of label on the pad covering the outlet ports brakes or latches the pad in its extended position. It is appreciated that the surface area of the disc 112 must be such that, with the vacuum developed in space 200, sufficient frictional force is provided between ridge 114 and pad carrier underside to override the force exerted by spring 86 in rectracting the pad 22.

Figure 9:
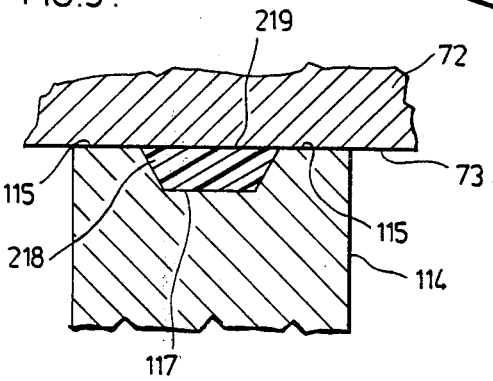
FIG. 9, which appears on the sheet of drawings including

To enhance the frictional engagement of the annual ridge 114 with the underside of the carrier block 72, an annular band 218 of solid urethane or the like, as shown in the enlarged section of FIG. 9, may be provided in the ridge 114 so as to generate better frictional contact with the underside 73 of plate 72. In forming the upper planar surface of disc ridge 114, a groove 117 is formed in the ridge. The solid urethane composition is molded in the groove and allowed to set so to be fixed therein. The upper surface of the ridge is then machined to provide a flush surface of metal edges 115 and planar portion 219 of urethane. This arrangement ensures a good frictional fit with the planar underside 73 of plate 72.

Springs 192 are used to lightly urge the disc upwardly to the plate underside. This ensures the immediate braking or retaining action on the pad to prevent its withdrawal in response to the presence of vacuum due to a label on the pad. It is appreciated, however, that the springs do not exert a force which would interfer with the effective retraction of the pad 22 in the event of no label on the pad. In the springs lightly urging the disc to the underside 73 of plate 72, any dust or foreign particles which may collect on the plate are wiped from the plate underside by the edge 115. This wiping action of the disc ridge with the planar plate reduces the effects of environmental dust by preventing dust and other foreign particles entering the enclosed space 120 and detracting from the braking action.

It is also appreciated that other forms of brakes or latches may be used, which in response to maintenance of a vacuum on the pad 22 by the presence of a label, locks or latches the pad in its extended position. For example, the presence of vacuum on the pad may be used to engage a latch with the underside of plate 72 to hold it in its extended position as vacuum is maintained on the pad. The latch is unlatched in the absence of vacuum on the pad.

Figure 7:
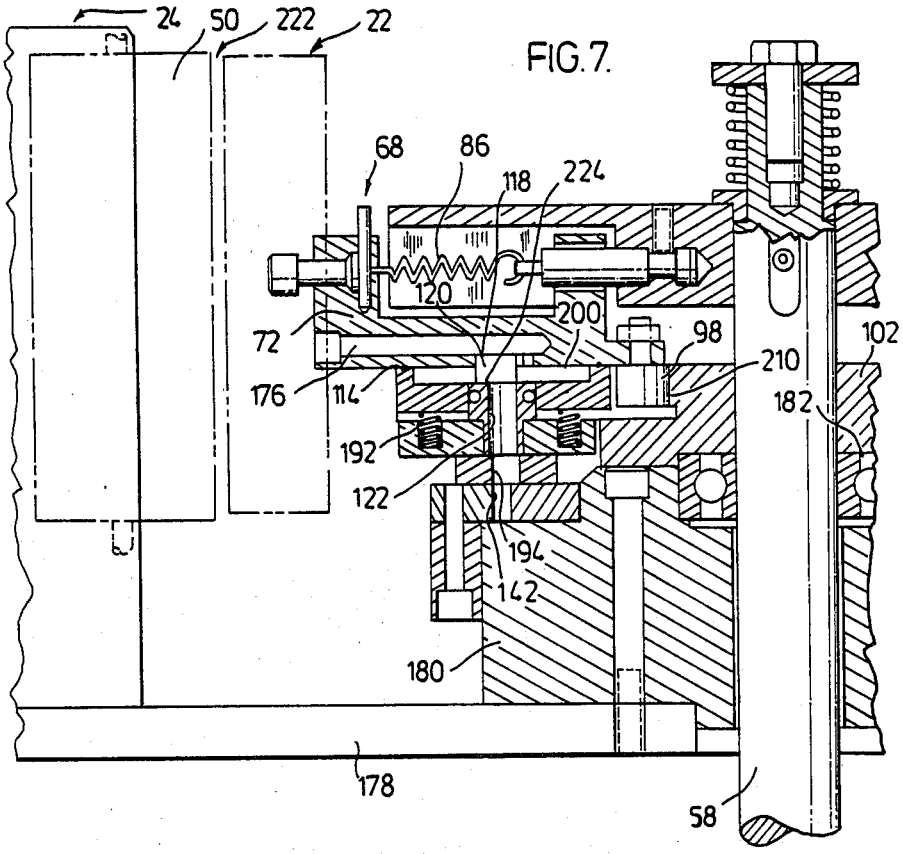
FIG. 7 is a section of the pad and drum where the pad is retracted due to the absence of a label on the pad's face.

Turning to FIG. 7, the situation is illustrated where a label is not present on the face of vacuum pad 22. Vacuum is provided to the system through port 142, wear ring aperture 194 and duct 122 to the disc enclosure area 200. As shown, the springs 192 lightly urge the disc annular ridge 114 against the underside of the pad carrier plate portion 72. Due to a loss of vacuum in the enclosure area 200, which could happen immediately at the point of improper label transfer where port 140 would be supplying vacuum to the vacuum pad, the cam follower 98 is allowed to ride down on ramp 212 to the reduced circumferential portion 210 of cam 102 under the influence of spring 86. The pad is now in its retracted position, as shown in FIG. 7. There is considerable space at 222 so that glue, as dispensed by glue roller 50, does not come in contact with the bare face of pad 22.

To avoid wasting vacuum as the wear ring aperture 194 passes over ports 140, 142 and 144 with the pad moved to its retracted position, a valve is actuated to shut off the supply of vacuum to the pad face. According to this embodiment and as discussed with respect to FIG. 3, a valve slide plug 120 is mounted on the underside of block carrier plate 72 in the recess 118. Block 120 is slightly undersized for recess 118 so as to loosely fit therein and thus ride on the upper surface 224 of the collar which defines aperture 122. The positioning of block 120 is such that, with the pad carrier 68 in its retracted position, the block 120 covers the outlet for duct 122 to thereby close off the vacuum to the enclosed area 200 and, in turn, to duct 176 which leads to the outlet ports 168 of the vacuum pad. A valving arrangement is provided which takes advantage of the pad withdrawal so as to close off the source of vacuum while the pad is in the retracted position. When the cam follower 98 rides up ramp 214 onto the outer circumferential portion 208, the valve block 120 moves therewith to the position shown in FIG. 6, so as to open communication of duct 122 to space 200.

It is appreciated that the pad may be mounted on the vacuum drum in other ways. Although the reciprocal motion has been described in detail for the pad and its carrier, it is also appreciated that the pad may be pivotally mounted on the drum where a plate would extend rearwardly from the pad face and could be engaged by the vacuum actuated brake, such as disc 112. Springs or the like could be used to constantly urge the pad to its retracted position. A cam follower could be mounted on the pad to pivot the pad to its extended position as it contacts an appropriate cam outline, which would function in a manner similar to cam 102.

With the brake device for holding the pad in its extended position being responsive to the presence or absence of vacuum on the vacuum pad, a reliable method is provided to withdraw the pad should a label either be absent from the pad or improperly positioned. With such arrangements, the pad is normally withdrawn as it passes by the glue applying device when no label is present on the pad to avoid gluing the pad. However, this vacuum is used as maintained by the presence of a label on the pad to actuate a brake device which precludes withdrawing the pad to thereby apply glue to a label. A vacuum pad arrangement is, therefore, provided which operates in a reliable manner in the unclean environments generated by paper particles and the like.

Although various preferred embodiments of the invention have been described herein in detail, it will be understood by those skilled in the art that variations may be thereto without departing from the spirit of the invention or the scope of the appended claims.

The embodiments of the invention in which an exclusive property or privilege is claimed are defined as follows:

1. An apparatus for labelling conveyed articles comprising means for transferring a label from a supply of labels onto a face of a pad mounted on a revolving drum, with the label's front against said pad face, means for controlling a supply of vacuum to an outlet means on said pad face, said control means providing a vacuum to hold a transferred label on said face and removing the vacuum as a label is applied to a conveyed container to release a label from said pad face, said revolving drum passing such held label by means for applying glue to the label back and contacting such glued label back to a conveyed article in a manner to deposit such glued released label on such article, said pad being movable relative to said drum from an extended position which contacts a label back with said glue applying means to retracted position which avoids contact with said glue applying means, as said drum rotates, means for biasing said pad toward said retracted position, means for extending said pad from its biased retracted position to said extended position, said extending means positioning said pad in said extended position with a label on said pad's face and in the absence of a label allowing said biasing means to retract said pad to its retracted position before said pad passes said glue applying means, means in response to a vacuum being maintained by a label on said pad face for retaining said pad in said extended position to apply glue to a label back and apply the glued label to a conveyed article, said retaining means being inactive in response to a loss of vacuum on said pad face due to the absence of a label over said outlet means thereby sllowing said biasing means to retract said pad to its retracted position and avoid contact with said glue applying means.

2. An apparatus of claim 1, wherein means is provided in response to said pad moving to its retracted position before passing by said glue applying means for interrupting said supply of vacuum.

3. An apparatus of claim 1, wherein said retaining means is activated by said maintained vacuum to retain said pad in its extended position.

4. An apparatus of claim 1, wherein said retaining means is a vacuum actuated brake, said brake cooperating with said pad to brake and thereby retain said pad in its extended position when vacuum as maintained by a label on said pad face is applied to said brake.

5. An apparatus of claim 1, wherein said retaining means is a vacuum actuated latch means, said latch means being adapted to latch said pad in its extended position when actuated by vacuum being maintained by a label on said pad face covering said outlet means.

6. An apparatus of claim 3, 4 or 5, wherein said pad is mounted on a slide which is mounted on said drum for radial reciprocal movement to and from the pad's extended position.

7. An apparatus of claim 3, 4 or 5, wherein said pad is pivotally mounted on said drum for pivotal movement to and from the pad's extended position.

8. An apparatus of claim 3, wherein said means for extending said pad maintains said pad in its extended position at least until a label is transferred onto and covers said outlet means of said pad face.

9. An apparatus of claim 8, wherein said retaining means is a selectively actuable suction cup, said suction cup being actuated by the vacuum maintained with a label over said outlet means to retain said pad in its extended position.

10. An apparatus of claim 1, wherein said label transfer means, said glue applying means and said area of contacting a glued label to a conveyed article are circumferentially spaced apart about said drum, said extending means extending said pad during drum rotation to its extended position after said glue applying means and before said area of contacting a glued label with conveyed article to support said pad, said extending means maintaining said pad in its extended position as said drum continues to rotate until after said label transfer means and before said glue applying means, said biasing means retracting said pad before said glue applying means when no label is present over said outlet means.

11. An apparatus of claim 10, wherein said extending means comprises a cam follower associated with said pad and a stationary cam provided relative to said revolving drum, said cam being so arranged that said biasing means constantly biases said cam follower toward said cam, the outline of said cam being such to extend said pad to said extended position as the drum rotates from said area of contacting a glued label to a conveyed article around to said label transfer means and to retract said pad for the remainder of its revolution to avoid contacting said pad with said glue applying means in the absence of a label over said outlet means.

12. An apparatus of claim 11, wherein said pad is mounted on a slide which is mounted on said drum for radial reciprocal movement to and from the pad's extended position, said cam follower being secured on said slide to move said pad toward and away from said pad extended position as said cam follower follows the outline of said cam during drum rotation.

13. An apparatus of claim 11, wherein said pad is pivotally mounted on said drum for pivotal movement to and from the pad's extended position, said cam follower being secured on said pad to pivot said pad toward and away from said pad extended position as said cam follower follows the outline of said cam during drum rotation.

14. An apparatus of claim 1, wherein said drum is mounted on a base plate for rotation about an axis, a plurality of said pads being mounted in an evenly spaced-apart manner around said drum, where the circumferential spacing between pads is equal to the spacing between evenly spaced-apart conveyed articles to be labelled, said retaining means being provided for each pad, said control means selectively applying vacuum to each of said pads during drum rotation, said retaining means being in communication with the supply of vacuum to each pad where in response to a vacuum being maintained by a label present over said outlet means, the respective retaining means retains the corresponding pad in its extended position to apply glue to a held label.

15. An apparatus of claim 14, wherein said means for extending said pad comprises a cam secured relative to said base plate, and each pad having a cam follower which is continually urged towards the outline of said cam by said biasing means as said drum rotates.

16. An apparatus of claim 15, wherein each pad is mounted for reciprocal radial movement between retracted and extended positions, said pad having a slide portion which is slidably mounted on said drum in a manner to always maintain desired pad orientation said pad when in its extended position defining as said drum rotates a circular path which is tangential with said label transfer means, said glue applying means and the area where a glued label is contacted with a container, said cam outline being circular and of a first diameter from the area where said pad contacts a label with a conveyed article around to the area where said transfer means completes a transfer of a label to the pad, said first diameter defining the extended position for said pad, said cam having a second smaller diameter for the remainder of cam circumference to define said retracted position for said pad.

17. An apparatus of claim 16, wherein said slide has a duct leading from said pad outlet means and which is in communication with said vacuum control means for selectively applying vacuum to said pad as it rotates, said slide actuating a valve to remove the supply of vacuum to said duct as said biasing means moves said pad radially inwardly due to an absence of a label on said outlet means after passing said label transfer means.

18. An apparatus of claim 17, wherein said slide comprises a body portion having means for mounting said body portion on said drum to provide for radial reciprocal movement of said pad between its retracted and extended positions, said mounting means being adapted to maintain a desired orientation of said pad relative to said drum, means for connecting said pad to said body portion with said duct in communication with said outlet means in said pad, said control means including a second duct in communication with the first duct of said slide body portion, said valve comprises a plug portion connected to said body portion which interrupts the communication between said first and second ducts as said biasing means retracts said slide to said pad retracted position.

19. An apparatus of claim 14, wherein said retaining means comprises a frictional brake for frictionally engaging a body portion supporting said pad on said drum, said frictional brake being stationary in the radial direction of said drum, said frictional brake in response to a vacuum being maintained by a label over said pad outlet frictionally engaging said pad body portion to prevent said biasing means moving said pad inwardly to its retracted position thereby retaining said pad in its extended position.

20. An apparatus of claim 19, wherein said frictional brake comprises a recessed brake body portion defining a planar encompassing ridge to frictionally engage a planar parallel surface on said pad body portion, said brake body portion being mounted stationary in a radial direction relative to said drum, said recessed brake body portion being in communication with the vacuum supplied to said pad outlet where the presence of a label over said inlet means increases the vacuum in the space defined by said recessed brake body to frictionally engage said closed ridge portion with the planar portion of said pad body, the frictional force of said ridge portion engaging said pad body portion being sufficient to preclude said biasing means moving said pad inwardly to its retracted position.

21. An apparatus of claim 20, wherein said brake recessed body portion comprises a disc having a raised annular ridge portion lying in a plane for frictional engagement with said planar pad body portion, said disc being mounted on said drum to engage lightly said planar body portion when vacuum is lost on said pad outlet means to permit said biasing means to move said pad to its retracted position.

22. An apparatus of claim 14, wherein each of said pads when in its extended position defines as said drum rotates a circular path which is tangential to said label transfer means, said glue applying means and an area at which a glued label is contacted with a conveyed container, the speed of rotation of said drum being determined by the conveyed article speed to contact a glued label against a desired location on each article surface, said drum being mounted on a spindle which rotates said drum at said predetermined speed, means for mounting each said pad for reciprocal radial movement on said drum, said mounting means having a planar surface with a duct extending from said pad outlet means to an opening in said planar surface, said retaining means comprising a cup-shaped disc having an annular ridge lying in a plane which is parallel to said plane of said mounting means, said disc being mounted on said drum so as to be stationary in a radial direction with said annualar ridge enveloping said opening, said disc defining an enclosed space which is in communication with said supply of vacuum, with a vacuum maintained in said space by a label over said outlet means, said disc ridge frictionally engages said planar surface with sufficient frictional force to prevent said biasing means moving said mounting means to said pad retracted position.

23. An apparatus of claim 22, wherein said annular ridge of said disc is planar and is provided with material which enhances the frictional engagement with said planar surface of the mounting means.

24. An apparatus of claim 22, wherein means urges said disc against said planar surface with minimal force to ensure formation of a vacuum in said space and to permit said biasing means to retract said pad when a label is absent over said outlet means.

25. An apparatus of claim 24, wherein said planar surface is provided on the underside of said mounting means, said disc being urged upwardly against said planar surface by spring means.

26. An apparatus of claim 25, wherein a second duct is provided through said disc and which communicates vacuum from said control means to said space, said disc being movable vertically while maintaining a seal on said second duct, said second duct having a second outlet in said space, said mounting means having means for sealing said second outlet when said mounting means is in said pad retracted position, said sealing means opening said second outlet when said mounting means is moved to said pad extended position.

27. An apparatus of claim 26, wherein said control means comprises a circumferential extending arcuate-shaped port means with said second duct having an outlet in communication with said port means as said drum rotates, the circumferential extent of and radial location of said port means providing vacuum to hold a label being transferred until such label is about to be contacted with a conveyed article.

28. An apparatus of claim 27, wherein said port means is in isolated segments to reduce the effect of a label not being present on one pad relative to pads which have labels.

29. An apparatus of claim 26, wherein said extending means comprises a cam mounted beneath said drum on said base plate and through which said spindle extends, said mounting means having a cam follower arranged for contacting said cam, said cam having an outline which, by virtue of said cam follower, extends said pad to its extended position to receive a label to be transferred, permits said biasing means to retract said pad upstream of said glue applying means in the absence of a label and downstream of said glue applying means extends said paid to support it for contacting a glued label with a conveyed container.

30. An apparatus of claim 1, 10 or 14, wherein said biasing means is a tension spring arranged to continuously retract said pad, the tension in said spring retracting said pad with a force less than the retaining force generated by said retaining means.

31. In a method for applying glue to a label preparatory to contacting such glued label to an article, comprising transferring a label onto a pad and holding such label on said pad by using vacuum, passing said pad by a means for applying glue to such label and contacting said pad to an article to place such glued label on the article and removing the vacuum to release the label at the time of contacting label to article, normally withdrawing said pad as it is passed by said glue applying means when no label is present on said pad to avoid applying glue to said pad and using the vacuum maintained by the presence of a label on said pad to actuate a brake means which precludes withdrawing said pad to apply thereby glue to the label on said pad.

32. In a method of claim 31, shutting off the supply of vacuum to said pad when a label is not transferred to said pad and the pad is withdrawn to avoid contact with said glue applying means.

* * * * *